US006321059B1

(12) United States Patent
Tamura

(10) Patent No.: US 6,321,059 B1
(45) Date of Patent: Nov. 20, 2001

(54) IMAGE FORMING APPARATUS

(75) Inventor: Satoshi Tamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,678

(22) Filed: Sep. 26, 2000

(30) Foreign Application Priority Data

Sep. 30, 1999 (JP) ..... 11-278590
Sep. 11, 2000 (JP) ..... 2000-275066

(51) Int. Cl.[7] ..... G03G 15/16

(52) U.S. Cl. ..... 399/297; 399/149; 399/302; 399/303; 399/308; 399/18; 399/21

(58) Field of Search ..... 399/149, 150, 399/297, 299, 302, 303, 304, 306, 308, 18, 21, 101

(56) References Cited

U.S. PATENT DOCUMENTS

| | | | |
|---|---|---|---|
| 4,162,843 | 7/1979 | Inoue et al. | 399/179 |
| 4,664,504 | 5/1987 | Oda et al. | 399/149 |
| 4,769,676 | 9/1988 | Mukai et al. | 399/150 |
| 5,282,007 | 1/1994 | Oshiumi | 399/150 |
| 5,283,618 | 2/1994 | Hosoya et al. | 399/150 |
| 5,550,620 | 8/1996 | Kimura et al. | 399/304 |
| 5,697,032 | 12/1997 | Kimura et al. | 399/302 |
| 5,911,100 | 6/1999 | Hasegawa et al. | 399/303 |
| 6,029,033 * | 2/2000 | Kawasaki | 399/149 |

FOREIGN PATENT DOCUMENTS

| | | |
|---|---|---|
| 0 354 310 | 2/1990 | (EP) . |
| 53-74037 | 7/1978 | (JP) . |
| 59-133573 | 7/1984 | (JP) . |
| 62-203182 | 9/1987 | (JP) . |
| 63-133179 | 6/1988 | (JP) . |
| 64-20587 | 1/1989 | (JP) . |
| 2-51168 | 2/1990 | (JP) . |
| 2-302772 | 12/1990 | (JP) . |
| 5-2287 | 1/1993 | (JP) . |
| 5-2289 | 1/1993 | (JP) . |
| 5-53482 | 3/1993 | (JP) . |
| 5-61383 | 3/1993 | (JP) . |

* cited by examiner

*Primary Examiner*—Robert Beatty
*Assistant Examiner*—Hoan Tran
(74) *Attorney, Agent, or Firm*—Fitzpatrick, Cella, Harper & Scinto

(57) ABSTRACT

An image forming apparatus including an image bearing member, a charger for contacting with and charging the image bearing member to form a latent image on the image bearing member, a developing device for developing the latent image formed on the image bearing member with a toner, the developing device collecting the toner on the image bearing member, an intermediate transfer member, and a transfer charger for transferring a toner image on the image bearing member to the intermediate transfer member, wherein the toner image transferred to the intermediate transfer member by the transfer charger is transferred to a recording material, and when the image forming operation is interrupted, the toner image on the image bearing member which is not yet transferred to the intermediate transfer member is transferred to the intermediate transfer member by the transfer charger.

37 Claims, 4 Drawing Sheets

IMAGE FORMING APPARATUS

BACKGROUND OF THE INVENTION

1. Field of the Invention

This invention relates to an image forming apparatus using the electrophotographic process, and particularly to an image forming apparatus such as a copier, a printer or a facsimile apparatus.

2. Related Background Art

In recent years, the downsizing and higher function of image forming apparatuses such as electrophotographic apparatuses have been advanced, while on the other hand, requirements such as improved reliability, system evolution, maintenance freedom and tenderness to human beings and environments have heightened, and various propositions have been made in order to meet those requirements.

For example, Japanese Patent Application Laid-Open No. 53-74037 (corresponding U.S. Pat. No. 4,162,843) proposes an image forming apparatus carrying thereon a plurality of photosensitive members (photosensitive drums) which are image bearing members for the outputting of color images, and sequentially transferring toner images while conveying a recording material (recording medium) by belt-shaped conveying means.

Also, there have been proposed many image forming apparatuses of the so-called intermediate transfer type in which toner images formed on a plurality of photosensitive members are sequentially superimposed onto an intermediate transfer member to thereby effect transfer, and further the toner images on the intermediate transfer member are collectively transferred to a recording material.

On the other hand, recently, there have appeared image forming apparatuses of a type called "cleaning simultaneous with developing" or "cleanerless" which eliminates cleaning means as an exclusive instrument by making developing means serve also as cleaning means for removing any toner residual on the surface of a photosensitive member after the transfer of a toner image to a recording material, particularly for the downsizing of the entire apparatus, the ecological countermeasure by being waste tonerless, the longer life of the photosensitive member and the curtailment of the amount of consumed toner per page (for example, Japanese Patent Application Laid-Open No. 59-133573, Japanese Patent Application Laid-Open No. 62-203182, Japanese Patent Application Laid-Open No. 63-133179, Japanese Patent Application Laid-Open No. 64-20587, Japanese Patent Application Laid-Open No. 2-51168, Japanese Patent Application Laid-Open No. 2-302772, Japanese Patent Application Laid-Open No. 5-2287, Japanese Patent Application Laid-Open No. 5-2289, Japanese Patent Application Laid-Open No. 5-53482, Japanese Patent Application Laid-Open No. 5-61383, etc.).

Cleaning simultaneous with developing is to shift any untransferred toner from a transferring portion to a developing portion, and collect it by a fog removal potential difference Vback which is the potential difference between a DC voltage applied to the toner bearing member (the toner supplying member and developing member) of developing means and the surface potential of the photosensitive member during the development in the next step and subsequent steps by the toner bearing member.

Again in the image forming apparatus of the above-described intermediate transfer type, it is eagerly waited for to adopt the cleaning simultaneous with developing system with the downsizing of the entire apparatus, the ecological countermeasure by the waste tonerless system, the extended life of the photosensitive member and the containment of the amount of consumed toner per page taken into account.

However, when the image forming operation (the developing operation, the transferring operation, etc.) is interrupted by the bad conveyance of a recording material conveyed onto a recording material bearing member or a recording material in the course of an image being formed on the intermediate transfer member, and the operation of discharging the recording material stagnating in the apparatus out of the apparatus is being performed, the amount of toner already formed on the photosensitive member and residual on the photosensitive member without being transferred to the recording material borne and conveyed by the recording material bearing member or to the intermediate transfer member becomes greater than usual. In the case of an image forming apparatus of the multiplex transfer type using the cleaning simultaneous with developing system as shown in Japanese Patent Application Laid-Open No. 5-53482, and when the cleaning simultaneous with developing system is applied to the above-described image forming apparatus of the intermediate transfer type, developing means is a mechanism for collecting the residual toner on the photosensitive member, and the above-mentioned great amount of residual toner passes under a charger for charging the photosensitive member to form a latent image and therefore, the charging potential of that portion lowers and when image formation is done next, there has occurred the phenomenon (hereinafter referred to as the "ghost") that the toner image formed on that portion becomes light or dense. Also, a great amount of residual toner adheres to the charger and causes the charging capability of the charger to be reduced, and it has required much time to properly charge such a great amount of residual toner and collect all of it into the developing means, and as the result, it has required much time to enter the next image forming operation.

Also, it has happened that a toner image already transferred to the recording material on the recording material bearing member or the intermediate transfer member during the occurrence of jam is counter-transferred to a photosensitive member disposed downstream thereof when it passes while contacting with that photosensitive member, and because the color of the toner image counter-transferred onto the photosensitive member and the color of the toner image formed on the photosensitive member disposed downstream differ from each other, toners of different colors are mixed together in the developing means to thereby cause color mixing and in the image formation thereafter, the colors of the final image change.

In order to avoid this problem, it is possible to adopt a construction in which when an abnormal situation such as the abnormal conveyance of a recording material happens when an image is being formed on the recording material conveyed onto the recording material bearing member or on the intermediate transfer member and the image forming operation is interrupted, the recording material bearing member or the intermediate transfer member and the photosensitive member are spaced apart from each other in the return sequence after the abnormal state has been eliminated, but there arises the problem that the construction of the apparatus becomes complicated and the cost thereof increases and the apparatus itself becomes bulky.

SUMMARY OF THE INVENTION

It is an object of the present invention to provide an image forming apparatus in which even if the image forming operation is interrupted, the poor charging of an image bearing member by charging means can be prevented from occurring.

It is another object of the present invention to provide an image forming apparatus in which when the transferring operation of first transfer charging means is interrupted, even if the developing operation of second developing means is not started, a toner of different color can be prevented from getting mixed in the second developing means and causing the formation of bad images.

Further objects of the present invention will become apparent from the following detailed description when read with reference to the accompanying drawings.

DESCRIPTION OF THE PREFERRED EMBODIMENTS

An image forming apparatus according to the present invention will hereinafter be described in detail with reference to the drawings.

(Embodiment 1)

Embodiment 1 of the present invention will hereinafter be described with reference to FIGS. 1 and 2.

Figure 1:
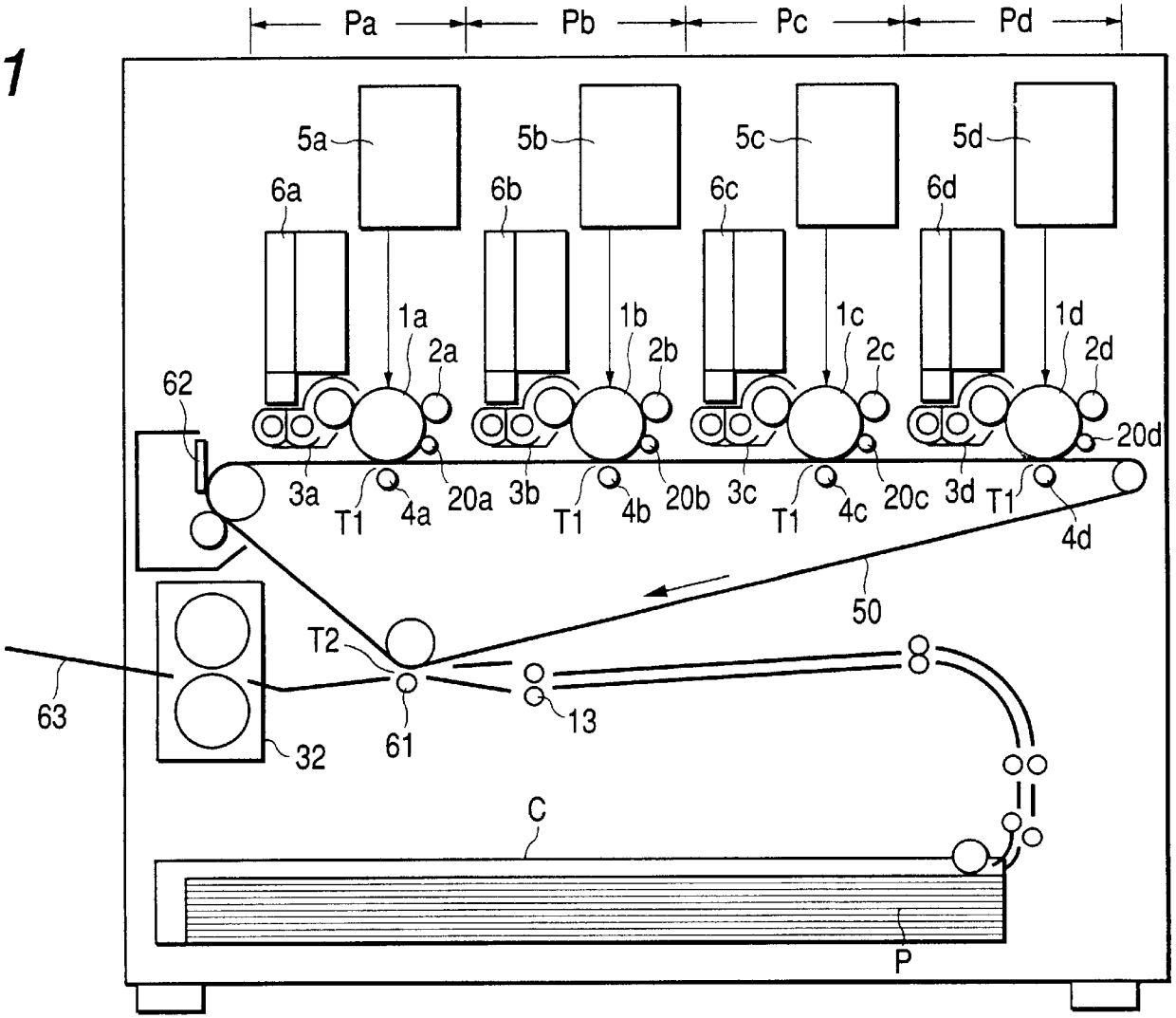
FIG. 1 schematically shows the construction of an image forming apparatus according to Embodiment 1.

In FIG. 1, the image forming apparatus according to the present embodiment has first, second, third and fourth image forming sections Pa, Pb, Pc and Pd juxtaposed therein, and toner images of different colors are formed via the processes of latent image formation, development and transfer.

Around photosensitive drums 1*a*, 1*b*, 1*c* and 1*d* as image bearing members, there are provided drum chargers 2*a*, 2*b*, 2*c* and 2*d* which are charging means, developing devices 3*a*, 3*b*, 3*c* and 3*d* which are developing means, and transfer chargers 4*a*, 4*b*, 4*c* and 4*d* as transfer charging means, and further, light source devices 5*a*, 5*b*, 5*c* and 5*d* and polygon mirrors or the like, not shown, are disposed in the upper portion of the apparatus.

The drum chargers 2*a*–2*d* are of a brush shape rotated (counter-rotated) while being in contact with each photosensitive drum, and each of them is a magnetic brush charger using a magnetic carrier. The magnetic carrier for charging may preferably have an average particle diameter of 10 to 100 $\mu$m, saturated magnetization of 20 to 250 emu/cm$^3$, and resistance of $1\times10^2$ to $1\times10^{10}$ $\Omega\cdot$cm, and taking it into account that defects of insulation like pinholes are present in the photosensitive drums 1*a*–1*d*, it is preferable to use a magnetic carrier having resistance of $1\times10^6$ $\Omega\cdot$cm or greater. To make the charging performance good, it is preferable to use a magnetic carrier having small resistance and therefore, use is made of magnetic particles having an average particle diameter of 25 $\mu$m, saturated magnetization of 200 emu/cm$^3$ and resistance of $5\times10^6$ $\Omega\cdot$cm. Also, the magnetic carrier for charging used is one obtained by subjecting the surface of ferrite to the oxidizing and reducing processes to thereby effect the adjustment of resistance. This magnetic carrier has the characteristic of frictionally charging the toner to minus (the same polarity as the normal charging polarity of the toner).

Laser beams emitted from the light source devices 5*a*–5*d* are scanned with the polygon mirrors rotated, and the scanned light beams thereof are changed by reflecting mirrors, and are condensed on the generatrix lines of the photosensitive drums 1*a*–1*d* charged by the drum chargers 2*a*–2*d* by fθ lenses and the photosensitive drums are exposed, whereby electrostatic latent images conforming to image signals are formed on the photosensitive drums 1*a*–1*d*.

The developing devices 3*a*–3*d* are filled with predetermined amounts of yellow, magenta, cyan and black toners as developers (the normal charging polarity of the toners is the negative polarity) by supplying devices 6*a*, 6*b*, 6*c* and 6*d*. Also, the developing devices 3*a*–3*d* are provided with rotatable developing sleeves as developer bearing members bearing the developers thereon. The toners borne as thin layers on the developing sleeves of the respective developing devices are carried to developing sections to thereby develop the latent images on the photosensitive drums 1*a*–1*d* and visualize them as a yellow toner image, a magenta toner image, a cyan toner image and a black toner image.

Then, the yellow toner image of the first color on the photosensitive drum 1*a* is transferred to an intermediate transfer member 50 by a transfer voltage (a voltage of the polarity opposite to the normal charging polarity of the toner, and in the present embodiment, a voltage of the positive polarity) applied to the transfer charger 4*a* by a high voltage source, not shown (primary transfer). Thereafter, in the same manner as that described above, electrostatic latent images are formed with respect to the second color, the third color and the fourth color, and are developed by the magenta developing device 3*b*, the cyan developing device 3*c* and the black developing device 3*d*, and a magenta toner image, a cyan toner image and a black toner image are transferred onto the intermediate transfer member 50 while being superposed one upon another, whereby a color image comprising the yellow, magenta, cyan and black toner images of four colors superposed one upon another is obtained on the intermediate transfer member 50. In the present embodiment, transfer biases applied to the transfer chargers 4*a*–4*d* are constant-current-controlled, and +10.0 [$\mu$A] is applied as the biases during transfer.

On the other hand, though slightly, untransferred toners are residual on the surfaces of the photosensitive drums 1*a*–1*d* after the transfer of the toner images. Such untransferred toners are carried to the charging areas of the chargers 2*a*–2*d* with the rotation of the photosensitive drums 1*a*–1*d*, and are once introduced into the magnetic brush chargers 2*a*–2*d*, and are charged to minus by the frictional charging with the magnetic carriers. At this time, a minus DC voltage is applied to the chargers to charge the surfaces of the photosensitive drums to desired minus potential and thus, the frictionally charged untransferred toners are again discharged onto the photosensitive drums.

Thus, the untransferred toners are once introduced from the photosensitive drums and therefore, the hysteresis of the previous images can be erased and the surfaces of the photosensitive drums in those portions can be charged well. Accordingly, at the exposing step which is the next step, electrostatic latent images can be formed well.

To effect the introduction of the untransferred toners into the chargers 2*a*–2*d* well, or to make the uniformity of the charging potential of the surfaces of the photosensitive drums good, it is preferable to apply an alternating voltage comprising an AC voltage superimposed on a DC voltage to the chargers 2*a*–2*d*. By applying the alternating voltage, the introduction of the toners into the chargers 2*a*–2*d* is easily effected by the vibration effect of the alternating electric field between the photosensitive drums and the chargers.

Also, the untransferred toners on the photosensitive drums 1*a*–1*d* are often a mixture of toners of the positive charging polarity and toners of the negative charging polarity due to the separation electric discharge or the like during transfer and therefore, when the ease of the introduction of the untransferred toners into the magnetic brush chargers 2*a*–2*d* is taken into account, it is preferable to charge the untransferred toners to the positive polarity (the polarity opposite to the normal charging polarity of the toners) by auxiliary charging means 20*a*–20*d* (such as corona chargers or contact chargers) before the untransferred toners are frictionally charged by the magnetic brush chargers 2*a*–2*d*.

Then, the untransferred toners charged by the chargers are collected into the developing devices by an electric field (formed by a voltage of the negative polarity being applied to the developing sleeves) formed in the developing section. By adopting such a construction, it becomes unnecessary to provide a cleaning device for exclusive use around each photosensitive member, and the apparatus can be simplified and further, it is possible to re-utilize (for development) the toners collected into the developing devices and therefore, the waste of the toners can be reduced. Also, when images are to be continuously formed on a plurality of recording materials, the developing operation for electrostatic latent images formed by the photosensitive drums charged by the chargers simultaneously with the above-mentioned collection being exposed is performed by the developing devices. By adopting such a construction, the throughput of image formation can be improved.

If during the occurrence of jam or the like, a great deal of untransferred toner adheres to the chargers for contacting with and charging such photosensitive drums for the formation of latent images, the charging capability for the untransferred toners and the charging capability for the photosensitive drums may be reduced.

The full color toner image of four colors formed on the intermediate transfer member 50 is collectively transferred onto the recording material P fed from a recording material cassette C and conveyed to the nip portion (secondary transfer portion) T2 between the intermediate transfer member 50 and a transfer roller 61 by registration rollers 13 in timed relationship with the full color toner image (secondary transfer). The transfer rollers 61 is brought into contact with the intermediate transfer member 50 immediately before the recording material P arrives at the nip portion T2. At the point of time of this contact, a transfer voltage (a voltage of the opposite polarity to the normal charging polarity of the toners; in the present embodiment, a voltage of the positive polarity) is applied to the transfer roller 61 by a high voltage source, not shown, whereby the collective transfer of the toner image of four colors from the intermediate transfer member 50 to the recording material P is effected.

Any toners not transferred by this secondary transfer and remaining on the intermediate transfer member 50 are scraped off from the intermediate transfer member 50 by a cleaning blade 62 as collecting means (cleaning), and are collected into a cleaner container. Also, design is made such that when in the course of an image being formed on the intermediate transfer member 50 (the course of the electrostatic latent images formed on the photosensitive drums being developed with the toners by the developing devices (developing operation), the abnormal conveyance of the recording material (e.g. the jam of the recording material in the sheet feeding path between the recording material cassette and the registration rollers occurs and the image forming operation (developing operation) is interrupted, the toner images already developed on the photosensitive drums are transferred to the intermediate transfer member 50 by the transfer chargers 4 so as not to go to the charging areas of the magnetic brush chargers, as will hereinafter be described in detail, and the toner images on the intermediate transfer member 50 thus transferred are also removed by the cleaning blade 62.

The intermediate transfer member 50 comprises a dielectric resin sheet such as a polyethylene terephthalate (PET) resin sheet, a polyvinylidene fluoride resin sheet, a polyurethane resin sheet or a polyimide resin sheet, and use is made of a belt having its opposite end portions joined together in overlapping relationship with each other, and formed into an endless shape, or a seamless belt.

Also, the intermediate transfer member 50 is adapted to contact with each photosensitive member at least when the toner image on each photosensitive member is being transferred. Further, the contact state between the intermediate transfer member 50 and each photosensitive member is maintained even when in the course of images being transferred to the intermediate transfer member 50 (the course of the electrostatic latent images formed on the photosensitive drums being developed with the toners by the developing devices (developing operation), the abnormal conveyance of the recording material (e.g. the jam of the recording material in the sheet feeding path between the recording material cassette and the registration rollers) occurs or when an abnormal situation in which the user forcibly opens a door or the like leading to the interior of the image forming apparatus during image formation occurs and the image forming operation (the transferring operation or the developing operation) is interrupted. Design is made such that as soon as the abnormal conveyance of the recording material occurs, the display means of the image forming apparatus (e.g. the liquid crystal display portion on the upper surface of the apparatus) displays the fact by control means (CPU) so that the recording material on the transfer belt may be removed by the user.

As the transfer chargers 4*a*–4*d*, use is made of non-contact chargers like corona discharge, or contact chargers using transfer charging members such as blades, rollers or brushes.

The non-contact chargers suffer from such a problem as the creation of ozone and the problem that charging is effected through the air and therefore the chargers are weak to the environmental fluctuations of the temperature and humidity of the atmosphere and images are not stably formed, whereas the contact chargers have such merits as being ozoneless, being strong against the environmental fluctuations of temperature and humidity, and a high quality of image.

The recording material P to which the toner image of four colors has been transferred is then conveyed to a fixing device 32. The recording material P to which the image of four colors has been transferred has the toner image thereon fused and color-mixed and fixed to the recording material P by the fixing device, whereby a full color copy image is formed, and the recording material P is discharged onto a discharge tray 63.

The drum chargers 2*a*–2*d* located around the photosensitive drums 1*a*–1*d* will now be described in detail.

Heretofore, in the electrophotographic system and the electrostatic recording system, a corona charger has been often used as means for carrying out the charging process (including the charge eliminating process) on an image bearing member (hereinafter referred to as the "photosensitive drum") such as an electrophotographic photosensitive member or an electrostatic recording dielectric member. This corona charger is disposed in non-contact and opposed relationship with the photosensitive drum, and the surface of the photosensitive drum is exposed to discharge corona produced by the corona charger to thereby charge the surface of the photosensitive drum to predetermined polarity and potential.

In recent years, a contact charging device (direct charging device) has been put into practical use because it has such merits as low ozone and low-power consumption as compared with the corona charger. This is such that a charging member to which a predetermined voltage has been applied is brought into contact with the photosensitive drum to thereby charge the surface of the photosensitive drum to predetermined polarity and potential. That is, the charging member is designed to be in contact with the surface of the photosensitive drum as long as the photosensitive drum (when any residual toner is present thereon, the residual toner as well) is charged.

A contact charging device using a magnetic brush as the charging member is preferably used from the viewpoint of the stability of charging and contact. In the contact charging device of this magnetic brush type, electrically conductive magnetic particles are magnetically bound and retained as a magnetic brush directly on a magnet or a sleeve containing a magnet therein, and the magnetic brush of the magnetic particles is brought into contact with the surface of the photosensitive drum while being stopped or rotated in a counter direction, and a negative voltage is applied thereto, whereby the charging of the photosensitive drum is started.

As the charging member, use can also be preferably made of electrically conductive fibers made into a brush shape (fur brush), or an electrically conducting rubber roller comprising electrically conductive rubber made into a roller shape.

The charge injecting method will now be described briefly.

In contact charging, a method of providing a charge injection layer on the surface of a photosensitive drum, and bringing a charging member to which a voltage has been applied into contact with this photosensitive drum to thereby inject charges into the charge injection layer and charge the surface of the photosensitive drum to predetermined polarity and potential is called the charge injecting method.

The charge injecting method, irrespective of the presence or absence of the superimposition of an AC voltage (AC bias) upon the charging member, can obtain surface potential substantially equal to an applied DC voltage (DC bias), and does not utilize such a discharge phenomenon that the charging of the photosensitive drum is effected by the use of a corona charger and therefore, completely ozoneless and low power consumption type charging becomes possible.

Description will now be made of the re-transfer phenomenon in a primary transfer portion (the disposed positions of the transfer chargers 4*a*–4*d*), i.e., a contact portion T1 in which the photosensitive drums 1*a*–1*d* and the intermediate transfer member 50 are in contact with each other.

Figure 2:
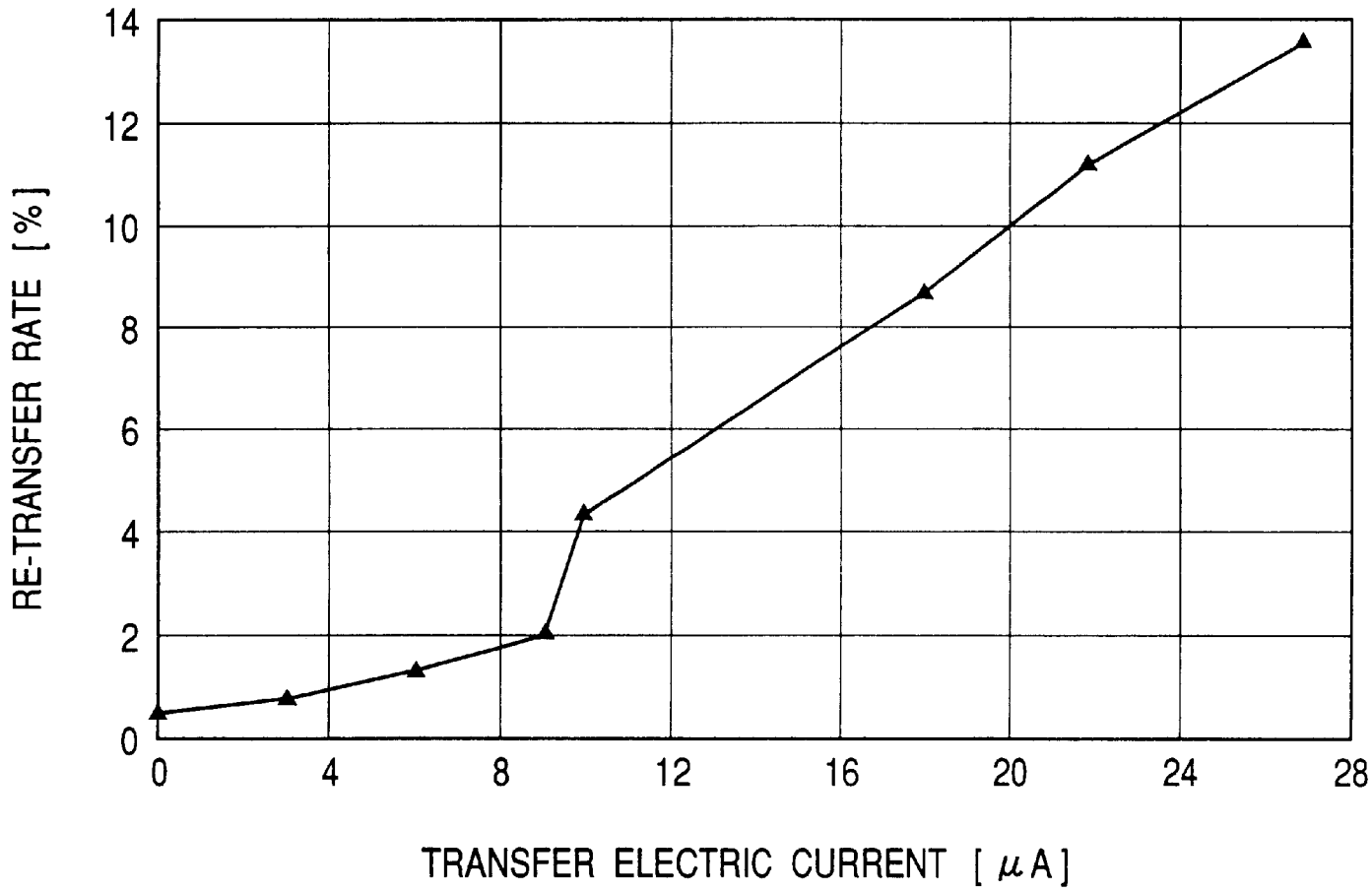
FIG. 2 is a graph showing the relation between the transfer electric current and the re-transfer rate.

FIG. 2 is a graph showing the correlation between a primary transfer electric current and the amount of re-transferred toner in the present embodiment, and the axis of abscissas plots the primary transfer electric current ($\mu$A), and the axis of ordinates plots the re-transfer rate (%) which is the weight ratio of the toner re-transferred to the photosensitive drum to the toner image (0.6 mg/cm$^2$) transferred to the intermediate transfer member.

The re-transfer in the primary transfer portion is the phenomenon that the toner image once transferred from the photosensitive drum to the intermediate transfer member is counter-transferred to the photosensitive drum when it again contacts with the photosensitive drum. Also, the re-transfer is the phenomenon that the toner charged to the polarity opposite to the ordinary polarity (reversely charged toner) by discharge or the like is counter-transferred to the photosensitive drum, and as shown in the graph of FIG. 2, it has been found that as the bias (opposite in polarity to the toner) applied in the primary transfer portion becomes greater, the amount of re-transferred toner also increases.

Description will now be made of the characteristic portion of the present invention, i.e., the returning operation when in the course of an image being transferred to the intermediate transfer member 50 (the course of the electrostatic latent image formed on the photosensitive drum being developed with the toner by the developing device (developing operation)), the abnormal conveyance of the recording material (e.g. the jam of the recording material in the sheet feeding path between the recording material cassette and the registration rollers) or an abnormal situation in which during image formation, the user forcibly opens the door or the like leading to the interior of the image forming apparatus occurs and almost all of the image forming operation including the developing operation is interrupted.

In the present embodiment, when the above-described abnormal situation occurs in the course of the image forming operation being performed, the rotation of the intermediate transfer member 50, a high voltage output applied to the chargers 2, the exposing operation of the exposing devices 5, a high voltage output applied to the transfer chargers 4 and the image forming operation such as the developing operation (a high voltage output applied to the developing devices and the rotation of the developing sleeves are stopped) are urgently stopped by the control means (CPU). When the clearance of obstruction such as sheet jamming which has caused the stoppage of the image forming operation is terminated (the abnormal conveyance of the recording material is solved), the intermediate transfer member 50 is rotated in preparation for the next image formation, and the operation of cleaning the surface of the intermediate transfer member 50 by the cleaner 62 (the cleaning of the toner images transferred from the photosensitive drums to the intermediate transfer member as will be described later) is performed.

When at the point of time whereat jam has occurred, a toner image is already formed on the photosensitive drum and the transfer of this toner image to the intermediate transfer member has not yet been completed, after the clearance of the above-mentioned obstruction has been done, the rotation of the photosensitive drum and the intermediate transfer member is started by the control device (CPU), and a transfer bias (bias equal to that during ordinary image formation) is applied to the transfer charger 4 in the pertinent image forming section P, whereby all the toner image on the pertinent photosensitive drum is transferred to the intermediate transfer member so that the toner image on the photosensitive drum may not arrive at the magnetic brush charger. At this time, it is preferable that the transfer bias be applied to the transfer charger during the time when the pertinent photosensitive drum makes at least one full rotation. By adopting such a construction, the toner residual on the pertinent photosensitive drum can be reduced as much as possible, and a great deal of toner can be prevented from arriving at the magnetic brush charger to cause bad image formation by the bad charging by the charger, and further, the time till the next image formation due to a reduction in the charging capability of the charger can be shortened as much as possible as compared with the prior art.

More preferably, in the image forming section P wherein the developing operation of the developing device 3 has not yet been started at the point of time whereat the abnormal situation has occurred, after the abnormal situation is eliminated, the image forming operation (the latent image forming operation and the developing operation) is not resumed, but for the prevention of the above-described re-transfer, a bias of +1.0 [$\mu$A] (a voltage of the polarity opposite to the normal charging polarity of the toner) is applied to the pertinent transfer charger 4.

This is for preventing the toner image transferred from the photosensitive drum to the intermediate transfer member in the primary transfer portion of the image forming section Pa after the clearance of jam because for example, the developing operation has already been performed when an abnormal situation (such as jam) has occurred from being re-transferred (counter-transferred) to the photosensitive drums 1*b*–1*d* in the primary transfer portions of the image forming sections Pb-Pd disposed downstream thereof, and the toner of a different color from getting mixed in the developing devices 3*b*–3*d*.

At this time, it is preferable that in order to prevent re-transfer, the bias applied to the transfer chargers 4*b*–4*d* be a current value in the same direction as a current value (e.g. +10.0 [$\mu$A]) applied to the transfer chargers 4*b*–4*d* during the ordinary transferring operation to the recording material and small in absolute value (a current value smaller in absolute value than the current value during ordinary transfer when the temperature and humidity conditions in the apparatus are substantially the same). It is preferable that the bias be a current value greater than at least 0 $\mu$A.

Also, when a constant voltage source (constant voltage control) is used as the transfer high voltage source, it is preferable that the re-transfer preventing bias be a voltage of the same polarity as the voltage applied during ordinary transfer and small in absolute value (a voltage smaller in absolute value than the voltage during ordinary transfer when the temperature and humidity conditions in the apparatus are substantially the same). It is preferable that the re-transfer preventing voltage be greater than at least 0 volt.

In the case of the present embodiment, it is +1.0 [$\mu$A] with it taken into account that the error of the high voltage output of the transfer high voltage source is ±1.0 [$\mu$A].

In the present embodiment, by the above-described construction, even when image formation is interrupted when an image is being formed on the intermediate transfer member, the phenomenon that only the remaining image portion of the photosensitive drum is reduced in charging potential or on the next image, the pre-image portion becomes light or dense (hereinafter referred to as the "ghost") can be simply prevented, and in a more preferred aspect, even when image formation is interrupted when an image is being formed on the intermediate transfer member, the occurrence of color mixing can be prevented by a simple construction.

(Embodiment 2)

Figure 3:
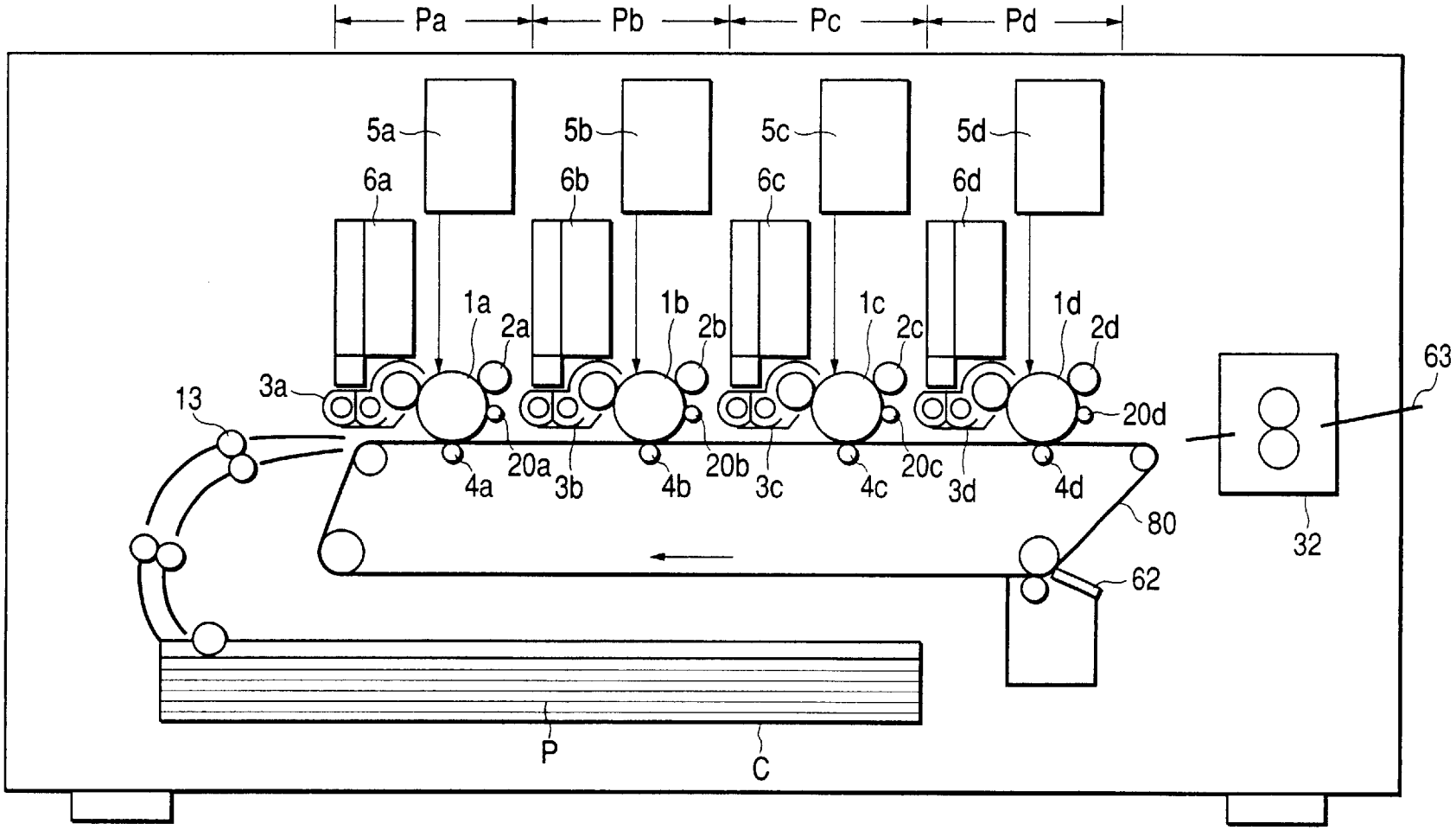
FIG. 3 schematically shows the construction of an image forming apparatus according to Embodiment 2.

Embodiment 2 will now be described with reference to FIG. 3. Embodiment 2 is such that as in Embodiment 1, the present invention is applied to an image forming apparatus of the multiplex transfer type to a recording material, and the details thereof will hereinafter be described.

Members functionally similar to those described in Embodiment 1 are given the same reference characters and need not be described in detail.

The image forming process will be described briefly. A yellow toner image formed on the photosensitive drum la in the image forming section Pa is sequentially transferred by the transfer charger 4*a* to a recording material P fed from the recording material cassette C, fed to a transfer belt 80 (transfer rotary member) as a recording material bearing member at predetermined timing by the registration rollers 13, and attracted to and borne on the transfer belt 80.

Thereafter, with respect also to the image forming sections Pb-Pd, the above-described transferring step is sequentially effected by the transfer chargers 4*b*–4*d*, whereby images of respective colors superposed one upon another are formed on the recording material P.

The transfer belt 80 comprises a dielectric resin sheet such as a polyethylene terephthalate (PET) resin sheet, a polyvinylidene fluoride resin sheet, a polyurethane resin sheet or a polyimide resin sheet, and use is made of a belt having its opposite end portions joined together in overlapping relationship with each other, and made into an endless shape, or a seamless belt.

The recording material P to which the toner images of four colors have been transferred is then conveyed to the fixing device 32. The recording material P to which the toner images of four colors have been transferred has the toner images thereon fused and color-mixed and fixed to the recording material P by the fixing device, whereby a full color copy image is formed, and the recording material P is discharged onto the discharge tray 63.

Description will now be made of the characteristic portion of the present invention, i.e., the returning operation when in the course of the image forming operation being performed, an abnormal situation (such as the abnormal conveyance of the recording material) occurs and the image forming operation is interrupted.

In the present embodiment, when an abnormal situation (such as the abnormal conveyance of the recording material) occurs in the course of the image forming operation being performed, the image forming operations such as the rotation of the transfer belt 80, a high voltage output applied to the chargers 2, the exposing operation of the exposing devices 5, a high voltage output applied to the transfer chargers 4 (a transfer high voltage output), and the developing operation (a high voltage output applied to the developing devices and the rotation of the developing sleeves are stopped) are urgently stopped. When the clearance of obstruction such as sheet jamming which has caused the stoppage of the image forming operation is completed (the abnormal conveyance of the recording material is solved), the transfer belt 80 is rotated in preparation for the next image formation, and the operation of cleaning the surface of the transfer belt 80 by the cleaner 62 (the cleaning of the toner images transferred from the photosensitive drums to the transfer belt 80 as will be described later) is performed.

As in Embodiment 1, the transfer belt 80 is designed to contact with each photosensitive member when it is transferring at least the toner image on each photosensitive member to the recording material borne on itself. Further, even when in the course of an image being transferred to the recording material on the transfer belt 80 (the course of the electrostatic latent image formed on the photosensitive drum being developed with the toner by the developing device), the abnormal conveyance (jam) of the recording material occurs in the sheet feeding path upstream of the transfer belt 80 with respect to the conveyance direction of the recording material (for example, the jam of the recording material occurs in the sheet feeding path between the recording material cassette and the registration rollers) and the image forming operation (developing operation) is interrupted, the contact state between the transfer belt 80 and each photosensitive member is maintained.

Also, when the abnormal conveyance of the recording material being conveyed by the transfer belt 80 occurs, the fact is displayed on the display means of the image forming apparatus (for example, the liquid crystal display portion on the upper surface of the apparatus) by the CPU so that the recording material on the transfer belt may be removed by the user. Design is made such that after the recording material is removed by the user, the contact state between the transfer belt and each photosensitive member is maintained in a jam return sequence hereinafter described in detail.

When at a point of time whereat the abnormal situation (such as jam) has occurred, a toner image is already formed on the photosensitive drum and the transfer of this toner image to the recording material P on the transfer belt is not yet completed, after the abnormal situation (such as the abnormal conveyance of the recording material) is eliminated, the rotation of the photosensitive drum and the transfer belt is started by the control device (CPU) and a transfer bias (a bias equal to that during ordinary image formation) is applied to the transfer charger 4 in the pertinent image forming section P, whereby all the toner image on the pertinent photosensitive drum is transferred to the transfer belt so that the toner image on the photosensitive drum may not arrive at the magnetic brush charger. Here, it is preferable that the transfer bias be applied to the transfer charger during the time when the pertinent photosensitive drum makes at least one full rotation. By adopting such a construction, the toner residual on the pertinent photosensitive drum can be reduced as much as possible, and a great deal of toner can be prevented from arriving at the magnetic brush charger to cause bad images by the bad charging by the charger, and further, the time till the next image formation due to a reduction in the charging capability of the charger can be shortened as much as possible as compared with the prior art.

More preferably, in the image forming section P wherein the developing operation of the developing device 3 has not yet been started at the point of time whereat the abnormal situation (such as jam) has occurred, the image forming operation is not resumed, but for the prevention of the above-described re-transfer, a bias of +1.0 [$\mu$A] (a voltage of the polarity opposite to the normal charging polarity of the toner) is applied to the pertinent transfer charger 4.

This is for preventing, for example, the toner image transferred from the photosensitive drum to the transfer belt in the transfer portion of the image forming section Pa after the clearance of jam because the developing operation has already been performed during the occurrence of an abnormal situation (such as jam) from being re-transferred (counter-transferred) to the photosensitive drums 1*b*–1*d* in the transfer portions of the image forming sections Pb-Pd disposed downstream thereof, and the toner of a different color from getting mixed in the developing devices 3*b*–3*d*.

At this time, it is preferable that the bias applied to the transfer chargers 4*b*–4*d* to prevent retransfer be a current value in the same direction as a current value (e.g. +10.0 [$\mu$A]) applied to the transfer chargers 4*b*–4*d* during the ordinary transferring operation to the recording material and small in absolute value (a current value smaller in absolute value than the current value during ordinary transfer when the temperature and humidity conditions in the apparatus are substantially the same). It is preferable that it be a current value greater than at least 0 $\mu$A.

Also, when a constant voltage source (constant voltage control) is used as the transfer high voltage source, it is preferable that the re-transfer preventing bias be a voltage of the same polarity as a voltage applied during ordinary transfer and small in absolute value (a voltage smaller in absolute value than the voltage during ordinary transfer when the temperature and humidity conditions in the apparatus are substantially the same). It is preferable that the re-transfer preventing voltage be greater than at least 0 volt.

In the present embodiment, as in Embodiment 1, even when the image forming operation is interrupted by the occurrence of an abnormal situation (such as the abnormal conveyance of the recording material), the phenomenon that only the remaining image portion is reduced in charging potential or on the next image, the pre-image portion becomes light or dense (hereinafter referred to as the "ghost") can be prevented by a simple construction, and further the occurrence of color mixing can be prevented.

While in the present invention, a transfer belt has been described as being used as the transfer rotary member, this is not restrictive, but the present invention can likewise be applied when the transfer rotary member is a transfer roller as will be described below. That is, the present invention can likewise be applied to an image forming apparatus using a single photosensitive drum and adopting the above-described "cleanerless" and "cleaning simultaneous with developing" system, and more particularly a black-and-white image forming apparatus in which a transfer bias is applied to a transfer roller cooperating with the photosensitive drum to nip and convey a recording material therebetween to thereby form a black-and-white image on the recording material. Again in such an image forming apparatus, when an abnormal situation such as jam occurs, the image forming operation (the rotating operation of the photosensitive drum and the transfer roller, the developing operation, the transferring operation, etc.) is urgently stopped, and the abnormal situation is eliminated, whereafter the return sequence is effected. That is, design is made such that the rotation of the photosensitive drum and the transfer roller is started (a state in which they contact with each other is maintained), and in order that a toner image already formed on the photosensitive drum may not arrive at a charger for charging the photosensitive drum, the above-mentioned toner image is transferred to the transfer roller. The toner image transferred to the surface of this transfer roller is cleaned by a cleaning device (e.g. a cleaning blade).

(Embodiment 3)

Embodiment 3 will now be described with reference to FIG. 4.

The construction and operation of an image forming apparatus according to the present embodiment are substantially similar to those of Embodiment 1 or Embodiment 2 and therefore need not be described.

The present embodiment differs from Embodiments 1 and 2 in the returning operation of removing the toner on the intermediate transfer member 50 or the transfer belt 80 after the abnormal conveyance of the recording material is solved when the image forming operation is interrupted by the occurrence of the above-mentioned abnormal conveyance, and returning the apparatus to a state in which it can perform ordinary image formation, and this operation will hereinafter be described.

Figure 4:
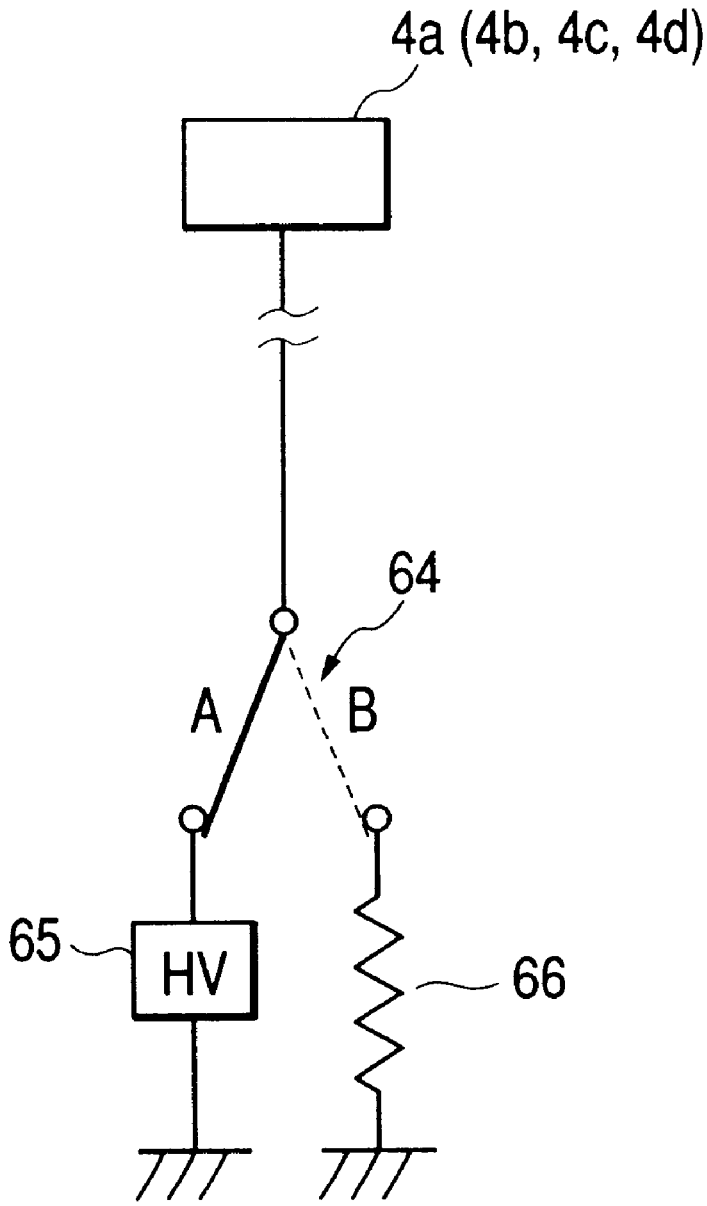
FIG. 4 is an illustration showing the operation of a transfer charger in Embodiment 3.

As shown in FIG. 4, in the present embodiment, the transfer chargers 4*a*, 4*b*, 4*c* and 4*d* are provided with a mechanism which can be selectively connected to one of a transfer high voltage source 65 and a grounded resistor 66 (a linear resistance element of which the current-voltage characteristic is linear) by a switch 64 as changeover means.

When ordinary image formation is to be performed, the transfer chargers 4*a*–4*d* are connected to the high voltage source 65 through the switch 64 which is in position A.

In the returning operation of removing the aforedescribed toner on the intermediate transfer member 50 or the transfer belt 80, and returning the apparatus to the state in which ordinary image formation can be performed, the developing operation is already performed and a toner image is formed on the photosensitive drum at a point of time whereat jam has occurred, and with regard to the image forming section P in which the transfer of this toner image to the recording material on the intermediate transfer member or the transfer belt has not yet been completed, the switch 64 is set at the position A by the control means (CPU.), and an ordinary transfer bias is applied to the transfer charger 4.

Also, with regard to the image forming section in which a toner image has not yet been formed on the photosensitive drum (the developing operation has not yet been started) at the point of time whereat jam has occurred, the switch 64 is changed over from its ordinary position A to position B by the control means (CPU), and the transfer charger 4 is connected to the grounded resistor 66. The resistor 66 used produces an induced current flowing in the same direction as an electric current applied when the toner image is transferred from the photosensitive drum 1 to the recording material on intermediate transfer member 50 or the transfer belt (ordinary time) and smaller in absolute value than the electric current during the ordinary time. Thus, as in Embodiments 1 and 2, a bias for preventing re-transfer is applied to the transfer charger 4 in the image forming section P wherein the developing operation has not yet been started when jam has occurred.

A similar effect can also be obtained by using a varistor which is a non-linear resistance element (impedance element) of which the current-voltage characteristic is non-linear or a diode instead of the resistor 66.

In the present embodiment, the induced electric current is used, whereby the re-transfer phenomenon can be prevented even if electric power (a voltage) is not applied to the transfer chargers and therefore, an effect similar to that of Embodiments 1 and 2 can be obtained by saved electric power.

What is claimed is:

1. An image forming apparatus comprising:

an image bearing member;

charging means for contacting with and charging said image bearing member to form a latent image on said image bearing member;

developing means for developing the latent image formed on said image bearing member with a toner, said developing means collecting the toner on said image bearing member;

an intermediate transfer member; and transfer charging means for transferring a toner image on said image bearing member to said intermediate transfer member, wherein the toner image transferred to said intermediate transfer member by said transfer charging means is transferred to a recording material, and wherein on a return after an image forming operation being interrupted, the toner image on said image bearing member which is not yet transferred to said intermediate transfer member is transferred to said intermediate transfer member by said transfer charging means.

2. An image forming apparatus according to claim 1, further comprising cleaning means for cleaning said intermediate transfer member.

3. An image forming apparatus according to claim 1, wherein said developing means collects the toner on said image bearing member simultaneously with developing the latent image formed on said image bearing member with the toner.

4. An image forming apparatus according to any one of claims 1 to 3, wherein said charging means charges the toner on said image bearing member.

5. An image forming apparatus according to claim 4, wherein said charging means charges the toner on said image bearing member to the same polarity as a normal charging polarity of the toner.

6. An image forming apparatus according to claim 5, further comprising auxiliary charging means for charging the toner on said image bearing member to a polarity opposite to the normal charging polarity of the toner before the toner on said image bearing member is charged by said charging means.

7. An image forming apparatus according to claim 6, wherein said charging means is provided with magnetic particles for frictionally charging the toner on said image bearing member charged by said auxiliary charging means to the same polarity as the normal charging polarity of the toner.

8. An image forming apparatus according to any one of claims 1 to 3, wherein when the image forming operation is interrupted by an abnormal conveyance of the recording material, after the abnormal conveyance of the recording material is solved, the toner image on said image bearing member which is not yet transferred to said intermediate transfer member is transferred to said intermediate transfer member by said transfer charging means.

9. An image forming apparatus comprising:

an image bearing member;

charging means for contacting with and charging said image bearing member to form a latent image on said image bearing member;

developing means for developing the latent image formed on said image bearing member with a toner, said developing means collecting the toner on said image bearing member; and a transfer rotary member for nipping a recording material between itself and said image bearing member to transfer a toner image on said image bearing member to the recording material, wherein on a return after an image forming operation being interrupted, the toner image on said image bearing member which is not yet transferred to the recording material is transferred to said transfer rotary member.

10. An image forming apparatus according to claim 9, further comprising cleaning means for cleaning said transfer rotary member.

11. An image forming apparatus according to claim 9, wherein said developing means collects the toner on said image bearing member simultaneously with developing the latent image formed on said image bearing member with the toner.

12. An image forming apparatus according to any one of claims 9 to 11, wherein said charging means charges the toner on said image bearing member.

13. An image forming apparatus according to claim 12, wherein said charging means charges the toner on said image bearing member to the same polarity as a normal charging polarity of the toner.

14. An image forming apparatus according to claim 13, further comprising auxiliary charging means for charging the toner on said image bearing member to a polarity opposite to the normal charging polarity of the toner before the toner on said image bearing member is charged by said charging means.

15. An image forming apparatus according to claim 14, wherein said charging means is provided with magnetic particles for frictionally charging the toner on said image bearing member charged by said auxiliary charging means to the same polarity as the normal charging polarity of the toner.

16. An image forming apparatus according to any one of claims 9 to 11, wherein the toner image on said image bearing member is transferred to the recording material conveyed while being borne on said transfer rotary member.

17. An image forming apparatus according to any one of claims 9 to 11, wherein when the image forming operation is interrupted by an abnormal conveyance of the recording material, after the abnormal conveyance of the recording material is solved, the toner image on said image bearing member which is not yet transferred to the recording material is transferred to said transfer rotary member.

18. An image forming apparatus comprising:

first and second image bearing members;

first and second charging means for contacting with and charging said first and second image bearing members, respectively, to form latent images on said first and second image bearing members;

first and second developing means for developing the latent images formed on said first and second image bearing members, respectively, with toners of different colors, said first and second developing means collecting the toners on said first and second image bearing members, respectively;

an intermediate transfer member provided so as to contact with said first and second image bearing members;

first transfer charging means for transferring a toner image on said first image bearing member to said intermediate transfer member; and second transfer charging means for transferring a toner image on said second image bearing member to said intermediate transfer member after the toner image is transferred from said first image bearing member to said intermediate transfer member by said first transfer charging means, wherein the toner images transferred to said intermediate transfer member by said first and second transfer charging means are transferred to a recording material, and wherein on a return after a transferring operation of said first transfer charging means being interrupted with a developing operation of said second developing means being not yet started, the toner image on said first image bearing member which is not yet transferred to said intermediate transfer member is transferred to said intermediate transfer member by said first transfer charging means, and a voltage of a polarity opposite to a normal charging polarity of the toner is applied to said second transfer charging means.

19. An image forming apparatus according to claim 18, wherein when the transferring operation of said first transfer charging means is interrupted and if the developing operation of said second developing means is not yet started, a voltage smaller in absolute value than a voltage applied to said second transfer charging means when the toner image on said second image bearing member is transferred to said intermediate transfer member is applied to said second transfer charging means.

20. An image forming apparatus according to claim 18 or 19, further comprising cleaning means for cleaning said intermediate transfer member.

21. An image forming apparatus according to claim 18 or 19, wherein said first and second developing means collect the toners on said first and second image bearing members, respectively, simultaneously with developing the latent images formed on said first and second image bearing members, respectively, with the toners.

22. An image forming apparatus according to claim 21, wherein said first and second charging means charge the toners on said first and second image bearing members, respectively.

23. An image forming apparatus according to claim 22, wherein said first and second charging means charge the toners on said first and second image bearing members to the same polarity as the normal charging polarity of the toners.

24. An image forming apparatus according to claim 23, further comprising first and second auxiliary charging means for charging the toners on said first and second image bearing members, respectively, to the polarity opposite to the normal charging polarity of the toners before the toners on said first and second image bearing members are charged by said first and second charging means, respectively.

25. An image forming apparatus according to claim 24, wherein said first and second charging means are provided with magnetic particles for frictionally charging the toners on said first and second image bearing members charged by said first and second auxiliary charging means to the same polarity as the normal charging polarity of the toners.

26. An image forming apparatus according to claim 18 or 19, wherein when the transferring operation of said first transfer charging means is interrupted by an abnormal conveyance of the recording material and if a developing operation of said second developing means is not yet started, after the abnormal conveyance of the recording material is solved, the toner image on said first image bearing member which is not yet transferred to said intermediate transfer member is transferred to said intermediate transfer member by said first transfer charging means, and said voltage is applied to said second transfer charging means.

27. An image forming apparatus according to claim 18 or 19, wherein when the transferring operation of said first transfer charging means is interrupted and if the developing operation of said second developing means is not yet started, the toner image on said first image bearing member which is not yet transferred to said intermediate transfer member is transferred to said intermediate transfer member by said first transfer charging means without said first and second image bearing member and said intermediate transfer member being spaced apart from each other, and said voltage is applied to said second transfer charging means.

28. An image forming apparatus comprising:

first and second image bearing members;

first and second charging means for contacting with and charging said first and second image bearing members, respectively, to form latent images on said first and second image bearing members;

first and second developing means for developing the latent images formed on said first and second image bearing members, respectively, with toners of different colors, said first and second developing means collecting the toners on said first and second image bearing members, respectively;

a recording material bearing member provided so as to contact with said first and second image bearing members, and bearing a recording material thereon;

first transfer charging means for transferring a toner image on said first image bearing member to the recording material borne on said recording material bearing member; and second transfer charging means for transferring a toner image on said second image bearing member to the recording material borne on said recording material bearing member after the toner image is transferred from said first image bearing member to the recording material borne on said recording material bearing member by said first transfer charging means, wherein on a return after a transferring operation of said first transfer charging means being interrupted with a developing operation of said second developing means being not yet started, the toner image on said first image bearing member which is not yet transferred to the recording material is transferred to said recording material bearing member by said first transfer charging means, and a voltage of a polarity opposite to a normal charging polarity of the toner is applied to said second transfer charging means.

29. An image forming apparatus according to claim 28, wherein when the transferring operation of said first transfer charging means is interrupted and if the developing operation of said second developing means is not yet started, a voltage smaller in absolute value than a voltage applied to said second transfer charging means when the toner image on said second image bearing member is transferred to the recording material borne on said recording material bearing member is applied to said second transfer charging means.

30. An image forming apparatus according to claim 28 or 29, further comprising cleaning means for cleaning said recording material bearing member.

31. An image forming apparatus according to claim 28 or 29, wherein said first and second developing means collect the toners on said first and second image bearing members, respectively, simultaneously with developing the latent images formed on said first and second image bearing members, respectively, with the toners.

32. An image forming apparatus according to claim 31, wherein said first and second charging means charge the toners on said first and second image bearing members, respectively.

33. An image forming apparatus according to claim 32, wherein said first and second charging means charge the toners on said first and second image bearing members to the same polarity as the normal charging polarity of the toners.

34. An image forming apparatus according to claim 33, further comprising first and second auxiliary charging means for charging the toners on said first and second image bearing members, respectively, to the polarity opposite to the normal charging polarity of the toners before the toners on said first and second image bearing members are charged by said first and second charging means, respectively.

35. An image forming apparatus according to claim 34, wherein said first and second charging means are provided with magnetic particles for frictionally charging the toners on said first and second image bearing members charged by said first and second auxiliary charging means to the same polarity as the normal charging polarity of the toners.

36. An image forming apparatus according to claim 28 or 29, wherein when the transferring operation of said first transfer charging means is interrupted by a abnormal conveyance of the recording material and if the developing operation of said second developing means is not yet started, after the abnormal conveyance of the recording material is solved, the toner image on said first image bearing member which is not yet transferred to the recording material is transferred to said recording material bearing member by said first transfer charging means, and said voltage is applied to said second transfer charging means.

37. An image forming apparatus according to claim 28 or 29, wherein when the transferring operation of said first transfer charging means is interrupted and if the developing operation of said second developing means is not yet started, the toner image on said first image bearing member which is not yet transferred to the recording material is transferred to said recording material bearing member by said first transfer charging means without said first and second image bearing members and said recording material bearing member being spaced apart from each other, and said voltage is applied to said second transfer charging means.

* * * * *